US005479727A

United States Patent [19]

Fine et al.

[11] Patent Number: 5,479,727

[45] Date of Patent: Jan. 2, 1996

[54] MOISTURE REMOVAL AND PASSIVATION OF SURFACES

[75] Inventors: Stephen M. Fine, Emmaus; Andrew D. Johnson, Doylestown; John G. Langan, Wescosville, all of Pa.

[73] Assignee: Air Products and Chemicals, Inc., Allentown, Pa.

[21] Appl. No.: 329,029

[22] Filed: Oct. 25, 1994

[51] Int. Cl.[6] ..... F26B 3/00

[52] U.S. Cl. ..... 34/516; 34/517

[58] Field of Search ..... 34/516, 517

[56] References Cited

U.S. PATENT DOCUMENTS

| | | | |
|---|---|---|---|
| 3,307,271 | 3/1967 | Simpson | 34/516 |
| 3,608,000 | 9/1971 | Anderson | 264/36 |
| 3,716,384 | 2/1973 | Anderson | 106/33 |
| 5,255,445 | 10/1993 | Li et al. | 34/22 |

FOREIGN PATENT DOCUMENTS

| | | |
|---|---|---|
| 2070145 | 12/1992 | Canada . |
| 177299 | 6/1991 | Japan . |

OTHER PUBLICATIONS

Tatenuma, K., et al. "Quick Acquisition of Clean Ultrahigh Vacuum by Chemical Process Technology." *J. Vac. Sci. Technol. A* 11(4) Jul./Aug. 1993:1719–1724.

*Primary Examiner*—John T. Kwon
*Attorney, Agent, or Firm*—Geoffrey L. Chase

[57] ABSTRACT

The present invention is a process of removal of moisture from surfaces, such as metal conduit for transmission of high purity gases in electronic component fabrication facilities, and the passivation of such metal surfaces to retard the readsorption of moisture, wherein the moisture removal and passivation is enhanced using an agent of the formula: $R_aSiX_bY_cZ_d$ where a =1–3; b, c, and d are individually 0–3 and a+b+c+d= 4; R is one or more organic groups; and at least one of X, Y or Z have a bond to silicon that is readily hydrolyzable. The moisture removal and passivation is conducted at less than 65° C. and at least ambient pressure.

15 Claims, 5 Drawing Sheets

MOISTURE REMOVAL AND PASSIVATION OF SURFACES

FIELD OF THE INVENTION

The present invention is directed to the field of moisture removal from surfaces and passivation of such surfaces to retard subsequent adsorption of moisture to such surfaces.

BACKGROUND OF THE PRIOR ART

The storage and delivery of ultra-high purity (UHP) gases is a critical issue to industry, particularly the electronics industry. To prepare a storage vessel or delivery manifold for ultra-high purity gas service, all the constituents of ambient air must be thoroughly removed from the system. Atmospheric contaminants, such are oxygen, nitrogen, and argon are gaseous and do not adsorb strongly on the metal walls of the vessel or delivery system. These gases are therefore easily removed from the system by purging with an inert gas, evacuating the system, or cycling the system between pressurized inert gas and vacuum.

Atmospheric moisture is different. It readily condenses on metal surfaces in multiple layers. Under normal atmospheric conditions less than 1 molecular layer of oxygen or nitrogen will physically adsorb on a metal surface. Under the same conditions, up to 125 molecular layers of moisture will adsorb on the metal. Moisture also adsorbs to metal surfaces more strongly than does oxygen or nitrogen. The activation energy of desorption for oxygen from a metal surface is about 3–4 kcal/mol. The activation energy of desorption of moisture is typically 15–20 kcal/mol. This large difference in activation energy corresponds to the desorption rate of moisture being about 100,000,000 times slower than the desorption rate of oxygen. This strong adsorption of multiple layers of moisture makes complete removal of moisture from a system a very difficult task. Typically, moisture is removed by purging or evacuation for long periods of time. In some cases it takes several weeks to adequately remove moisture from a delivery system. This is an expensive, time consuming process. Sometimes systems are heated to high temperature to reduce the time required to remove moisture. However heating is not always practical, and it does nothing to prevent re-adsorption of water if the system is again exposed to ambient atmosphere.

In many cases, moisture is the critical contaminant in the gas delivery system. This is especially true when the gas is corrosive. Gases such as hydrogen chloride, hydrogen bromide, fluorine, tungsten hexafluoride, and other halogen containing gases will severely corrode many metals if moisture is present. Corrosion of the storage vessel or delivery manifold can result in introduction of impurities, particles or gas-phase, into the ultra-high purity gas or in extreme cases failure of the system. Component such as valves, regulators, and mass flow controllers are very susceptible to failure due to corrosion and frequently need to be replaced. However, if moisture is rigorously removed, these gases will not corrode commonly used metals such as stainless steel and aluminum. Methods are needed to rapidly remove adsorbed water and passivate the metal surface such that re-adsorption of water is inhibited. Such methods would shorten the time required to completely remove moisture from a system and protect expensive components from failure.

Specifically a method is required which can meet the following needs.

1. Reduce the amount of time it takes to dry down a system to a specified moisture level.
2. Generate a hydrophobic surface that inhibits water from re-adsorbing after the treatment.
3. Enhance point-of-use purity for gases.
4. Improve the corrosion resistance of the materials of construction.
5. Enhance stability of the process gas, especially gas mixtures having a low concentration level of one component.
6. Prevent moisture transients from being dampened.

Previous investigators have developed methods for chemically removing moisture from a metal surface. However, none of these methods have been shown to produce a stable hydrophobic surface. Y-E. Li, J. Rizos, and G. Kasper (U.S. Pat. No. 5,255,445 and Canadian Patent Application number 2,070,145) disclose a method to dry a metal surface to enhance the stability of a gas mixture contacting such surface. Their method is to expose a purged metal surface to a drying agent consisting of one or more gaseous hydrides in low concentration. In their examples, they show that the stability of a low concentration mixture of arsine in argon is improved if the cylinder is first treated with a silane. However, if the metal surface is re-exposed to moisture the beneficial effect of silane treatment is destroyed. This demonstrates that silane treatment does not produce a stable hydrophobic surface.

K. Tatenuma, T. Momose, and H. Ishimaru (J. Vac. Sci. Technol. A, 11, 1719 (1993)) and Japanese Patent number 177299 describe a method to chemically remove moisture using reactive organic halides such as $COCl_2$ and $CH_3CCl_2CH_3$, at either room or elevated temperature. These compounds react with surface bound moisture to form gaseous by-products which are more easily removed than moisture. Their experiment was to expose a UHV vacuum chamber to a vapor of the moisture-reactive chemical for 10 minutes between 1 and 5 times. The time for the system to pump down to $10^{-7}$ and $10^{-8}$ torr was then measured and compared with the pump-down time of an untreated chamber. Treatment with $CH_3CCl_2CH_3$ was found to dramatically shorten the pump-down time. Treatment with chlorotrimethylsilane was found to have little or no effect on shortening the pump-down time as reported in Table 1 of the article. Experiments to determine if surface treatment was stable to re-exposure to moisture were not performed.

The present invention overcomes the drawbacks in the prior art of preparing piping for ultra high purity gas delivery service by using a class of reagents in a novel process to reduce the amount of time it takes to dry down a system to a specified moisture level, generate a hydrophobic surface that inhibits water from re-adsorbing after the treatment, enhance point-of-use purity for gases, improve the corrosion resistance of the materials of construction, enhance stability of process gas, especially gas mixtures having a low concentration of a component, and prevent moisture transients from being dampened; as set forth in greater detail below.

BRIEF SUMMARY OF THE INVENTION

The present invention is a process for moisture removal and moisture passivation of a surface on which moisture is absorbed comprising contacting the surface at a pressure of at least approximately 14.7 psia with a flow of a carrier gas containing a drying reagent to remove absorbed moisture from the surface and to passivate the surface to retard the readsorption of moisture, wherein the drying reagent is a composition of the formula: $R_aSiX_bY_cZ_d$ where a=1–3; b, c, and d are individually 0–3 and a+b+c+d=4; R is one or more organic groups; and X, Y and Z are individually hydrogen, halogen, alkoxy, amine or —N(H)Si($R_3$), but at least one of X, Y or Z have a bond to silicon that is a readily hydrolyzable.

Preferably, the organic groups are selected from the group consisting of alkyl, alkenyl, alkynyl, aryl, alkyl-, alkenyl- or alkynyl-substituted aryl, aryl substituted alkyl-, alkenyl- or alkynyl- and mixtures thereof.

Preferably, the drying reagent is a composition of the formula:

$$R_aSiH_{4-a}$$

wherein R is alkyl, alkenyl, alkynyl, aryl, alkyl-, alkenyl-or alkynyl-substituted aryl, aryl substituted alkyl-, alkenyl- or alkynyl- and mixtures thereof, and a is 1–3.

Alternatively, the drying reagent is a composition of the formula:

$$X_aSiH_bR_c$$

wherein R is alkyl, alkenyl, alkynyl, aryl, alkyl-, alkenyl- or alkynyl-substituted aryl, aryl substituted alkyl-, alkenyl- or alkynyl- and mixtures thereof, X is fluorine, bromine, chlorine, iodine or mixtures thereof, and a, b and c are individually 1–2, and a+b+c=4.

Further alternatively, the drying reagent is a composition of the formula:

$$R_aSi(OR')_{4-a}$$

wherein R and R' are alkyl, alkenyl, alkynyl, aryl, alkyl-, alkenyl- or alkynyl-substituted aryl, aryl substituted alkyl-, alkenyl- or alkynyl- and mixtures thereof, and a is 1–3.

Alternatively, the drying reagent is a composition of the formula:

$$HN(SiR_3)_2$$

wherein R is alkyl, alkenyl, alkynyl, aryl, alkyl-, alkenyl- or alkynyl-substituted aryl, aryl substituted alkyl-, alkenyl- or alkynyl- and mixtures thereof.

Preferably, the flow of a carrier gas containing a drying reagent contacts the surface at a temperature less than approximately 65° C.

Preferably, the surface is a metal surface. More preferably, the metal surface is steel.

Preferably, the metal surface is an interior of piping of a high purity gas delivery device.

The present invention is also a process for moisture removal and moisture passivation of an interior surface of a high purity gas piping on which moisture is absorbed, comprising: (a) purging the piping with an inert gas which has a moisture content below 0.1% by volume; and (b) contacting the surface at a pressure of at least approximately 14.7 psia and a temperature of between 10° C. and 65° C. with a flow of a carrier gas containing a drying reagent to remove absorbed moisture from the surface and passivate the surface to retard the readsorption of moisture, wherein the drying reagent is a composition of the formula: $R_aSiX_bY_cZ_d$ where a=1–3; b, c, and d are individually 0–3 and a+b+c+d=4; R is one or more organic groups; and X, Y and Z are individually hydrogen, halogen, alkoxy, amine or —N(H)Si($R_3$), but at least one of X, Y or Z have a bond to silicon that is readily hydrolyzable.

DETAILED DESCRIPTION OF THE INVENTION

Figure 1:
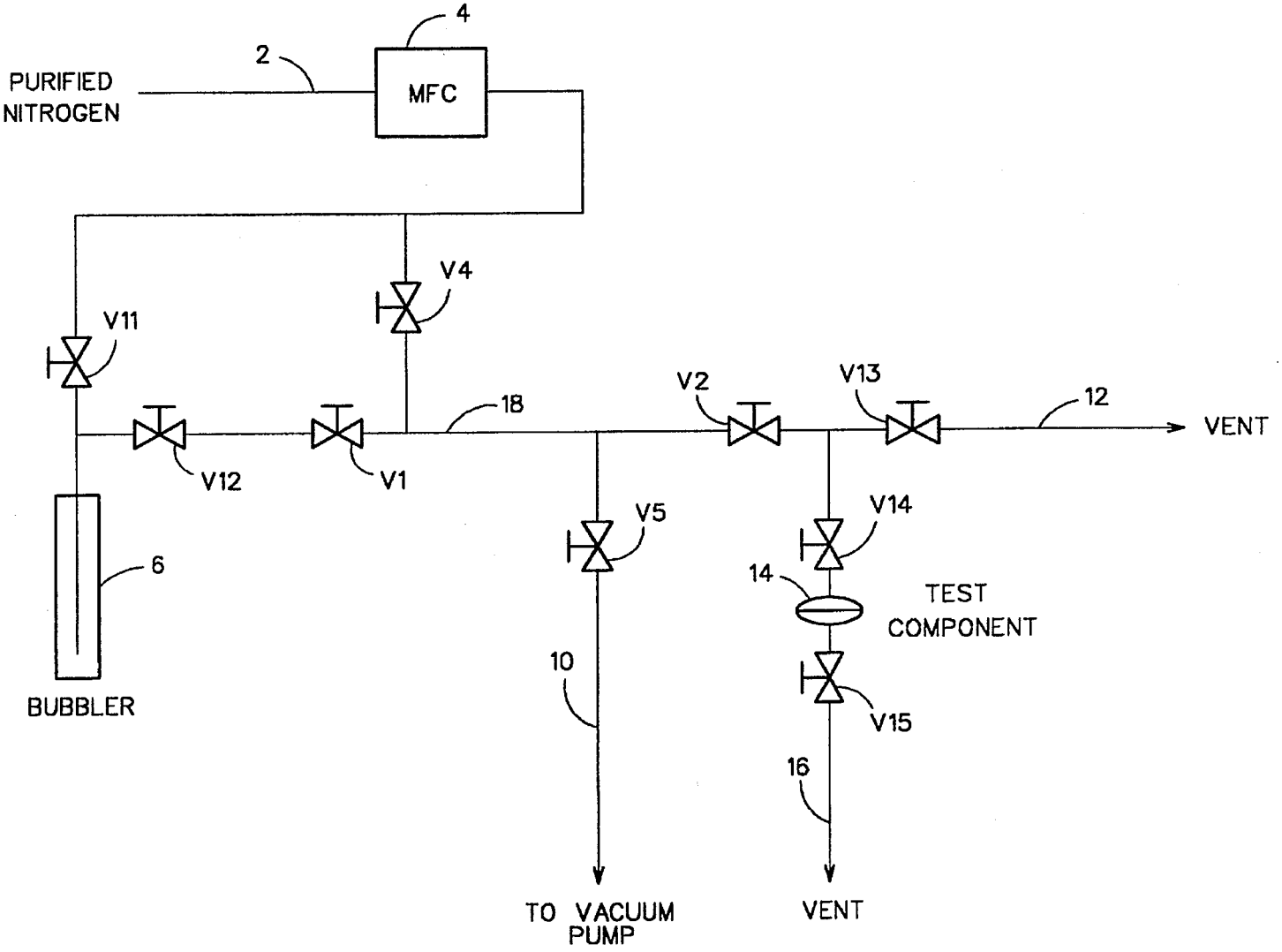
FIG. 1 is a schematic illustration of the test apparatus used to perform the moisture removal and moisture passivation of the present invention.

The present invention is a process for removing moisture from metal surfaces used with high purity bulk and corrosive-specialty gases. Furthermore, the present invention passivates the metal at ambient to superambient pressures by forming a hydrophobic surface that prevents water from re-adsorbing. Benefits of the process include the ability to deliver ultra-high purity (UHP) gases and protection of the delivery system from component failure. UHP gases have less than 1% by volume of any undesired components. Preferably, UHP gases have less than 100 ppm of undesired components. Most preferably, UHP gases have less than 1 ppm of undesired components. Reagents of the type $R_aSiX_bY_cZ_d$ where a=1–3; b, c, and d are individually 0–3 and a+b+c+d=4; R is one or more organic groups; and X, Y and Z are individually hydrogen, halogen, alkoxy, amine or —N(H)Si($R_3$), but at least one of X, Y or Z have a bond to silicon that is readily hydrolyzable, are shown to remove surface adsorbed moisture and produce a stable hydrophobic surface. R is preferably alkyl, alkenyl, alkynyl, aryl; alkyl-, alkenyl-or alkynyl-substituted aryl; aryl substituted alkyl-, alkenyl- or alkynyl- and mixtures thereof. More preferably, R is individually chosen from one or more hydrocarbon groups comprising $C_1$–$C_6$, such as methyl, ethyl, vinyl, propyl, butyl, pentane, hexyl, cyclohexyl, phenyl, as well as iso and tertiary forms of those substituents.

The most preferred moisture removal and moisture passivating agents for the present invention are those that have a very readily hydrolyzable bond to silicon (e.g. Si—N, Si—H, Si—Cl, Si—Br), are liquids with normal boiling points in the range of 0°–130° C., and form thermally stable species of the type $R_3Si$—O—M bound to a metal surface. Specific compounds which meet this criteria are hexamethyldisilazane, trimethylsilane, ethyldimethylsilane, diethylmethylsilane, chlorotrimethylsilane, chlorodimethylvinylsilane, chlorodimethylethylsilane, chlorodimethylisopropylsilane and bromotrimethylsilane. In general, the most preferred compounds for this process are of the type $R_3Si$—X where R=$C_1$– $CH_3$ hydrocarbons and X=H, Cl, Br or an amino group.

A bond to silicon that is readily hydrolyzable is for the purpose of the present invention a substituent bound to silicon where the bond is readily cleaved by reaction with moisture (gas phase, dissociated or undissociated surface bound water) leaving the silicon with any other silicon bound substituents to bond with the surface or an oxygen atom associated with the surface.

An inert gas for purposes of the present invention is inert to reaction with the materials of construction of the surface being treated. Where the surface is a metal, such as iron, steel, aluminum, copper, brass, nickel, nickel alloys, etc., the inert gas would not react with these metals under the conditions contemplated for the surface: 0–3000 psia and –50° C. to 250° C. Exemplary are nitrogen, argon, helium and other noble gases.

Water dissociatively adsorbs on metals, saturating the surface with OH groups, and hydrogen bound water also contacts the metal surface, as well as contacts the initial OH layer adjacent the metal surface. Recombinative desorption of OH and H is a slow process that controls the dry down time and ultimate moisture level. A class of derived organosilanes has been identified (Table 1) that chemically react with surface bound moisture which at atmospheric pressure (approximately 14.7 psia) results in the formation of a hydrophobic moiety bound to the metal/metal oxide surface.

TABLE 1

| Candidate drying agents* | | |
|---|---|---|
| Drying Agent | Series | |
| organosilanes | $RySiH_{4-y}$ | R = Me, Et, Pr, Bu, Vinyl, Pen, Hex, Ph<br>y = 1, 2, 3 |
| haloorganosilanes | $X_yR_{4-y}Si$<br>$X_aR_bH_cSi$ | X = F, Cl, Br, I<br>R = Me, Et, Pr, Bu, Vinyl, Pen, Hex, Ph<br>a,b,c,y = 1, 2, 3<br>a + b + c = 4 |
| organoalkoxysilanes | $R_y(OR')_{4-y}Si$ | R = Me, Et, Pr, Bu, Vinyl, Pen, Hex, Ph<br>R'= Me, Et, Pr, Bu, Vinyl, Pen, Hex<br>y = 1, 2, 3 |
| disilazanes | $HN(SiR_3)_2$ | R = Me, Et, Pr, Bu, Vinyl, Pen, Hex, Ph |

*where Me = methyl, Et = ethyl, Pr = propyl, i-Pr = isopropyl, Bu = normal, iso or tertiary butyl, Pen = normal, iso or tertiary pentyl, Hex = normal, iso or tertiary hexyl, Ph = phenyl.

These drying agents react with adsorbed moisture to form a gaseous product (HX). Since water is removed from the surface by chemical reaction rather than by thermal reassociation, the initial dry down is faster. Although not wanting to be bound to any particular theory of the mechanism of the present process, an exemplary equation for the reaction of the surface bound water is set forth below.

$$M—O—H+R_aSiX_bY_cZ_d \rightarrow M—O—SiR_aY_cZ_d+HX$$

where M is a metal surface to which the hydroxyl group of a water molecule is bound and the remaining variables are as defined above.

This reaction is favored because of the exothermicity of Si—O bond formation. In addition to removing adsorbed water, the treatment, when conducted at near ambient to superambient pressures incorporates stable organosilicon moieties into the surface which destroys the polar character associated with the OH terminated surface. The treated surface is hydrophobic and inhibits water from re-adsorbing during a subsequent moisture exposure. This retained hydrophobic character of the treated surface is referred to in the present invention as passivation. Removal of adsorbed water and prevention of readsorption is known to be the key to reduced dry down times, improved corrosion resistance and the stability of reactive gases.

The present invention can typically be carried out to remove moisture and induce moisture passivation of an interior surface of a high purity gas piping on which moisture is absorbed by purging the piping with an inert gas which has a moisture content below 0.1% by volume, contacting the surface at a pressure of at least approximately 14.7 psia and a temperature of between 10° C. and 65° C. with a flow of a carrier gas containing a drying reagent to remove absorbed moisture from the surface and passivate the surface to retard the readsorption of moisture, wherein the drying reagent is a composition of the formula: $R_aSiX_bY_cZ_d$ where a=1–3; b, c, and d are individually 0–3 and a+b+c+d=4; R is one or more organic groups; and X, Y and Z are individually hydrogen, halogen, alkoxy, amine or —N(H)Si ($R_3$), but at least one of X, Y or Z have a bond to silicon that is readily hydrolyzable. The efficacy of the present invention is demonstrated by the following examples. The R group in the radical —N(H)Si($R_3$) is as defined above, namely one or more organic groups, more preferably alkyl, alkenyl, alkynyl, aryl; alkyl-, alkenyl- or alkynyl-substituted aryl; aryl substituted alkyl-, alkenyl- or alkynyl- and mixtures thereof, most preferably, R is individually chosen from one or more hydrocarbon groups comprising $C_1$–$C_6$, such as methyl, ethyl, vinyl, propyl, butyl, pentane, hexyl, cyclohexyl, phenyl, as well as iso and tertiary forms of those substituents.

EXAMPLE 1

Passivation of Electropolished Stainless Steel Tubing with Hexamethyldisilazane, (HMDS).

A 12 meter length of ¼" diameter electropolished 316L tubing 14 fitted with a valve V14 and V15 on each end was equilibrated with nitrogen containing 950 ppb moisture at 25 psia. The valves V14 and V15 were then closed and the tubing 14 attached to the manifold 18 shown in FIG. 1. The bubbler 6 in the manifold 18 contained 35 mL of HMDS. With V11 and V12 closed, the manifold was cycled between $10^{-3}$ torr vacuum, through valve V5 and vacuum source 10, and 25 psig UHP $N_2$ (#2) ($H_2O$<20 ppb) 10 times to remove contaminants. The flow rate on the mass flow controller (MFC) 4 was then set to 500 sccm and V11, V12, V1, V2, and V13 were opened and V4 closed. In this way, the manifold 18 was passivated with HMDS by flowing HMDS saturated nitrogen to vent 12 for 3 minutes. After 3 minutes, V13 was closed and V14 and V15 were opened. The 500 sccm flow of HMDS saturated nitrogen was allowed to pass through the test component 14 and vent 16 for 90 seconds at a pressure of 14.7 psia. After which, V14 and V15 were closed. The HMDS saturated nitrogen was then allowed to react with the moisture in the tubing 14 for 15 minutes at a pressure of 30 psia. During this time, V11 and V12 were closed and the rest of the manifold 18 was repeatedly cycled between vacuum and UHP $N_2$ to remove all the HMDS vapor. A 500 sccm flow of nitrogen was then established by setting the mass flow controller 4 and opening V4, V2, and V13. At the end of the 15 minute reaction period, the HMDS vapor was purged at a pressure of 14.7 psia from the test component 14 by closing V13, and opening V14 and V15. The test component 14 was then purged for 8.5 minutes at a pressure of 14.7 psia, after which V14 and V15 were closed and the isolated length of tubing was transferred to a moisture analyzer.

EXAMPLE 2

Initial Dry-Down of HMDS Passivated Electropolished Stainless Steel Tubing.

Figure 2:
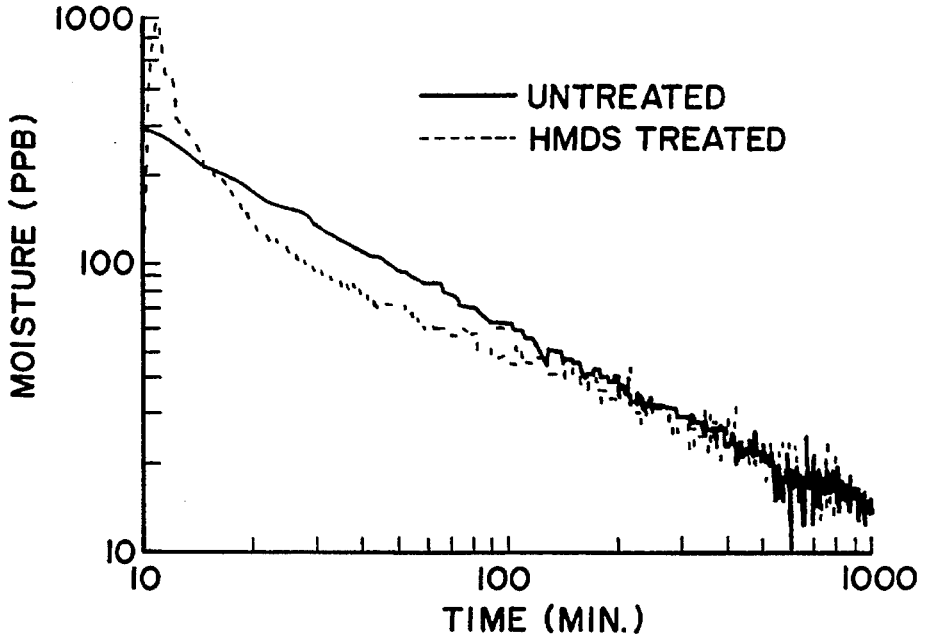
FIG. 2 is a graph of moisture (ppb) vs. time (min.) for a test tubing passivated with hexamethyldisilazane showing shortened drydown to 100 ppb $H_2O$ for the treated tube.

Following the passivation described in Example 1, the EP 316L tubing test component was purged with UHP $N_2$ ($H_2O$<20 ppb, 500 sccm at a pressure of 14.7 psia) while monitoring the outlet moisture level with a certified, quartz crystal oscillator (Ametek 5700). FIG. 2 shows dry-down curves before, and immediately, after HMDS treatment. The time taken to passivate the tubing (10 min.) has been included in the purge time and so no moisture level is measured during the first 10 min. of the dry-down curve. The untreated tubing dries down to 100 ppb in 48 min., whereas the HMDS treatment enhances the rate of moisture removal, reducing the dry-down time to 28 min.

EXAMPLE 3

Amount of Moisture Adsorbed by Electropolished Stainless Steel Tubing Following HMDS Passivation.

Figure 3:
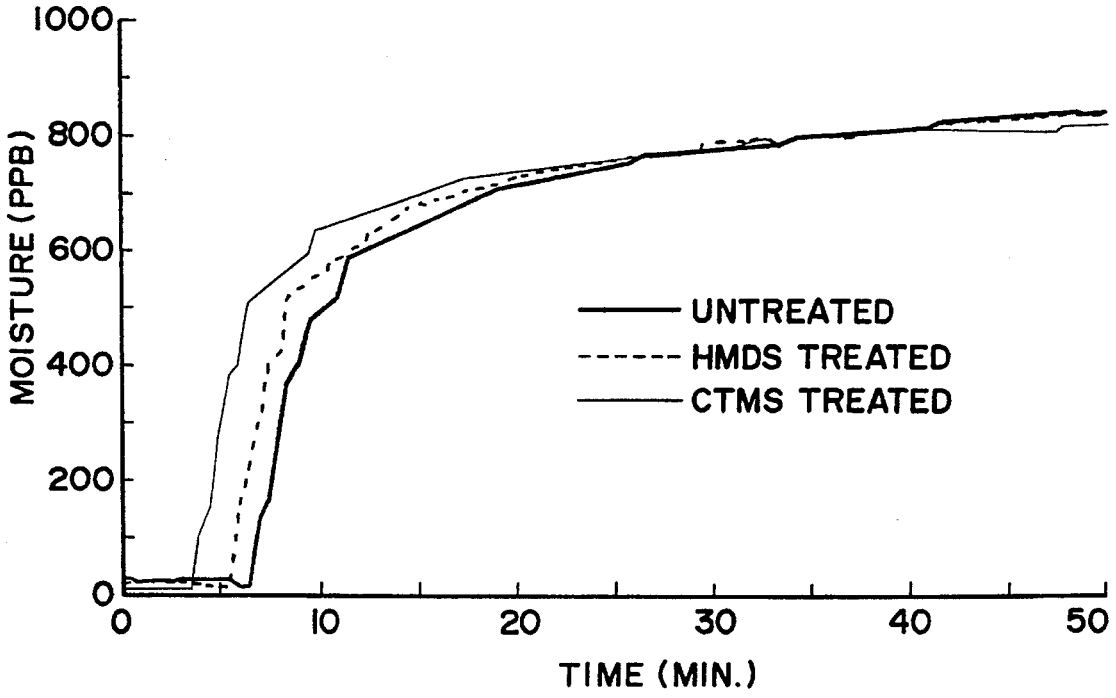
FIG. 3 is a graph of moisture (ppb) vs. time (min.) for a test tubing passivated with hexamethyldisilazane and subsequently chlorotrimethylsilane showing shortened breakthrough (therefore, less $H_2O$ readsorption) of moisture over an untreated tube.

After passivating (Example 1) and drying down to less than 20 ppb (Example 2), the EP 316L tubing test component was exposed to a moisture level of 950 ppb. FIG. 3 shows the moisture uptake curves for the untreated and HMDS treated tubing. At time zero, the purge gas (500 sccm) is switched from UHP $N_2$ ($H_2O$<20 ppb) to $N_2$ having 950 ppb of water. There is a delay of 7.5 min. until the moisture front is detected at the tube outlet. This breakthrough time is reduced to 6 min. by HMDS treatment, suggesting less water re-adsorbs on the walls of the tubing.

EXAMPLE 4

Passivation of Electropolished Stainless Steel Tubing with Chlorotrimethylsilane, (CTMS).

After HMDS passivating (Example 1), drying down to less than 20 ppb (Example 2), and re-exposing the tubing to a moisture level of 950 ppb (Example 3), the 12 meter length of test component tubing was passivated with CTMS. The bubbler shown in FIG. 1 was filled with 35 mL of CTMS and the procedure described in Example 1 was followed. The test component (length of tubing) was passivated by flowing 500 sccm of CTMS saturated nitrogen through the tubing for 1.5 minutes at a pressure of 14.7 psia. V14 and V15 were then closed and the CTMS saturated nitrogen was then allowed to react with the moisture in the tubing for 15 minutes. The CTMS vapor was purged from the test component for 8.5 minutes, after which V14 and V15 were closed and the isolated length of test component tubing was transferred to the moisture analyzer.

EXAMPLE 5

Initial Dry-Down of CTMS Passivated Electropolished Stainless Steel Tubing.

Figure 4:
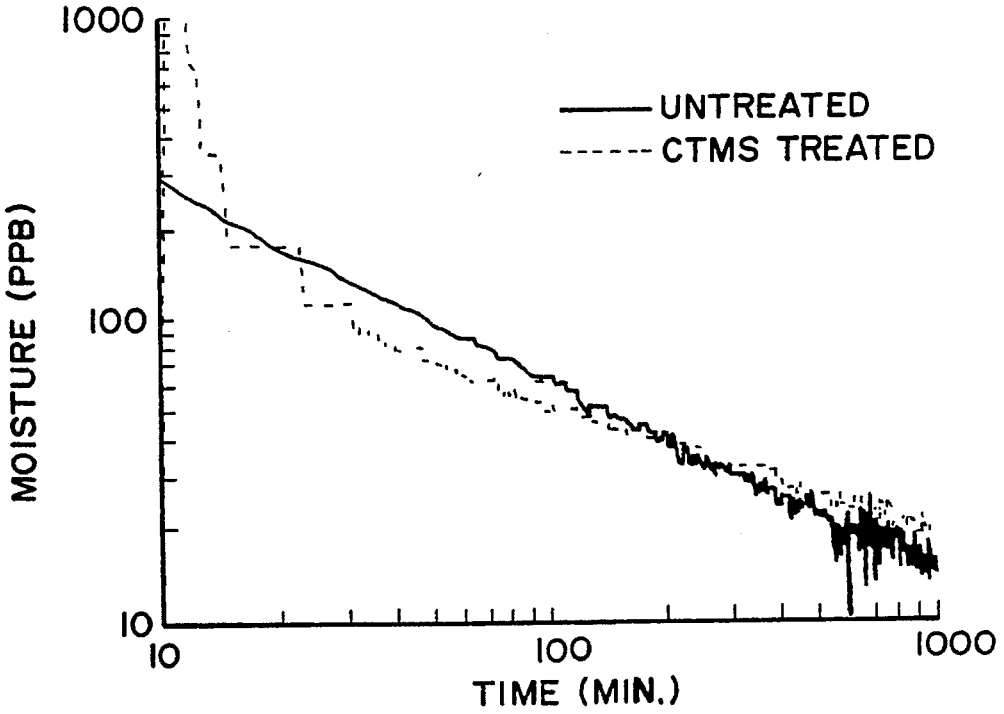
FIG. 4 is a graph of moisture (ppb) vs. time (min.) for a test tubing passivated with chlorotrimethylsilane showing shortened drydown to 100 ppb $H_2O$ for the treated tube.

Following the passivation described in Example 4, the EP 316L tubing test component was purged with UHP $N_2$ (500 sccm) while monitoring the outlet moisture concentration. FIG. 4 shows dry-down curves before, and immediately, after CTMS treatment. The time taken to passivate the test component tubing (10 min.) has been included in the purge time and so no moisture level is measured during the first 10 min. of the dry-down curve. The untreated test component tubing dries down to 100 ppb in 48 min. whereas the CTMS treatment enhances the rate of moisture removal, reducing the dry-down time to 30 min.

EXAMPLE 6

Amount of Moisture Adsorbed by Electropolished Stainless Steel Tubing Following CTMS Passivation.

Figure 5:
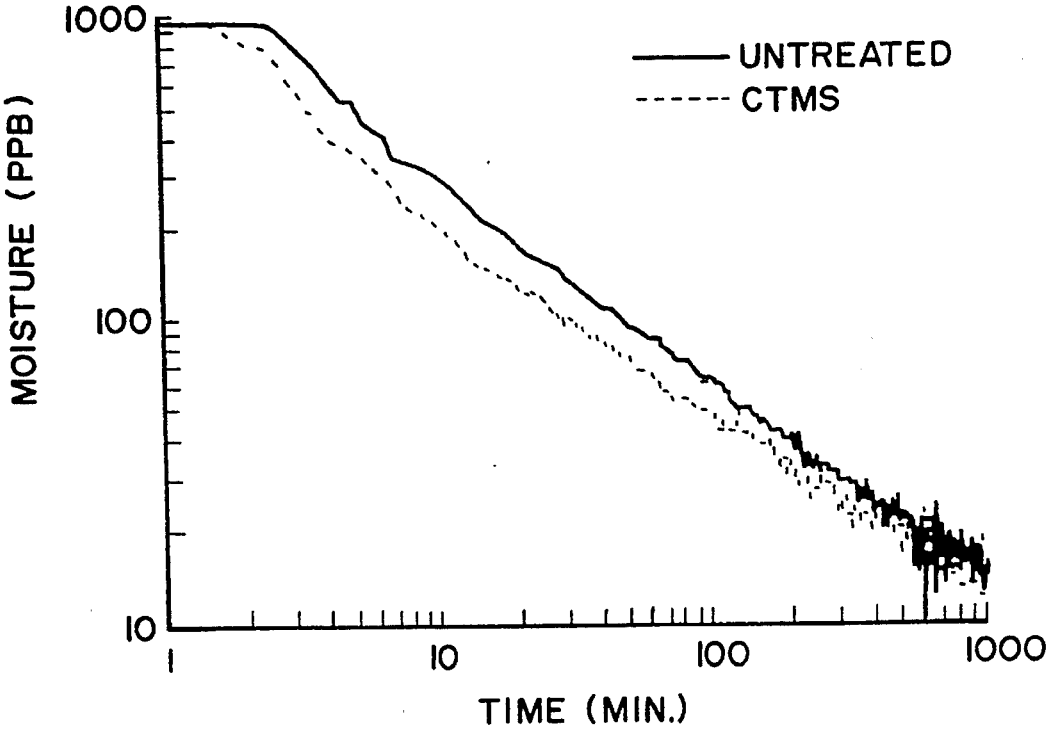
FIG. 5 is a graph of moisture (ppb) vs. time (min.) for a test tubing passivated with chlorotrimethylsilane showing shortened drydown to 100 ppb $H_2O$ for the treated tube after equilibration of the tubing with nitrogen containing 950 ppb of moisture.

Example 5 shows that CTMS can rapidly remove water adsorbed on stainless steel during the treatment, reducing the dry-down time. CTMS also inhibits water from re-adsorbing during a post-treatment moisture exposure by producing a stable, hydrophobic surface (passivation). FIG. 3 shows the moisture uptake curves for untreated and CTMS-treated EP 316L tubing. At time zero, the purge gas is switched from UHP $N_2$ ($H_2O$<20 ppb) to $N_2$ having a moisture level of 950 ppb. It takes 7.5 min. for the moisture front to appear at the outlet of the untreated tubing whereas the breakthrough time for CTMS treated EP 316L is only 3.5 min. This breakthrough time is longer than the gas residence time (0.3 min) and results from water adsorbing on the walls of the tubing. The shorter breakthrough time after treatment means that less water adsorbs onto the tube surface during the moisture exposure. A lower surface coverage, and the stability of the passivated surface is apparent from the dry down curve after equilibrating at 950 ppb (FIG. 5).

EXAMPLE 7

Passivation of Stainless Steel Gas Filter with Chlorotrimethylsilane, (CTMS) at Room Temperature.

A stainless steel gas filter fitted with a valve on each end was equilibrated with nitrogen containing 1 ppm moisture. The valves were then closed and the filter attached to the manifold shown in FIG. 1. The bubbler in the manifold contained 35 mL of CTMS. Using the procedure described in Example 1, the test component (gas filter) was passivated by flowing 500 sccm of CTMS saturated nitrogen through the filter for 1.5 minutes at a pressure of 14.7 psia. V14 and V15 were then closed and the CTMS saturated nitrogen was then allowed to react with the moisture in the test component (gas filter) for 15 minutes. The CTMS vapor was purged from the test component for 8.5 minutes, after which V14 and V15 were closed and the isolated test component (gas filter) was transferred to the moisture analyzer.

EXAMPLE 8

Initial Dry-Down of Room Temperature CTMS Passivated Gas Filter.

Figure 6:
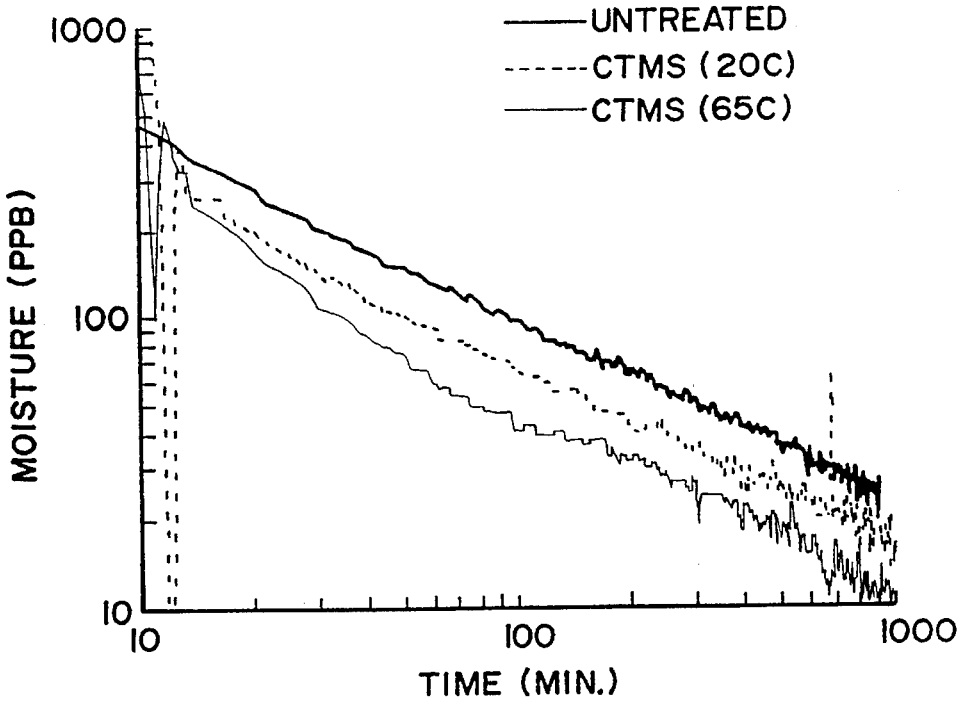
FIG. 6 is a graph of moisture (ppb) vs. time (min.) for a test stainless steel filter passivated with chlorotrimethylsilane at 20° C. and 65° C. showing shortened drydown to 50 ppb $H_2O$ for the treated filter at 65° C., an intermediate drydown time for the treated filter at 20° C. and the longest drydown time for the untreated filter.

Following the passivation described in Example 7, the stainless steel filter was purged with UHP $N_2$ ($H_2O$<20 ppb, 500 sccm) while monitoring the outlet moisture concentration. FIG. 6 shows dry-down curves for the filter before, and immediately after this room temperature CTMS treatment. The time taken to passivate the test component filter (10 min.) has been included in the purge time and so there is no moisture measurement during the first 10 min. of the dry-down curve. The untreated filter dries down to 50 ppb in 300 min. whereas the CTMS treatment enhances the rate of moisture removal, reducing the dry-down time to 140 min., which is over a factor of 2 in improvement.

EXAMPLE 9

Re-wetting of Room Temperature CTMS Passivated Gas Filter.

Figure 7:
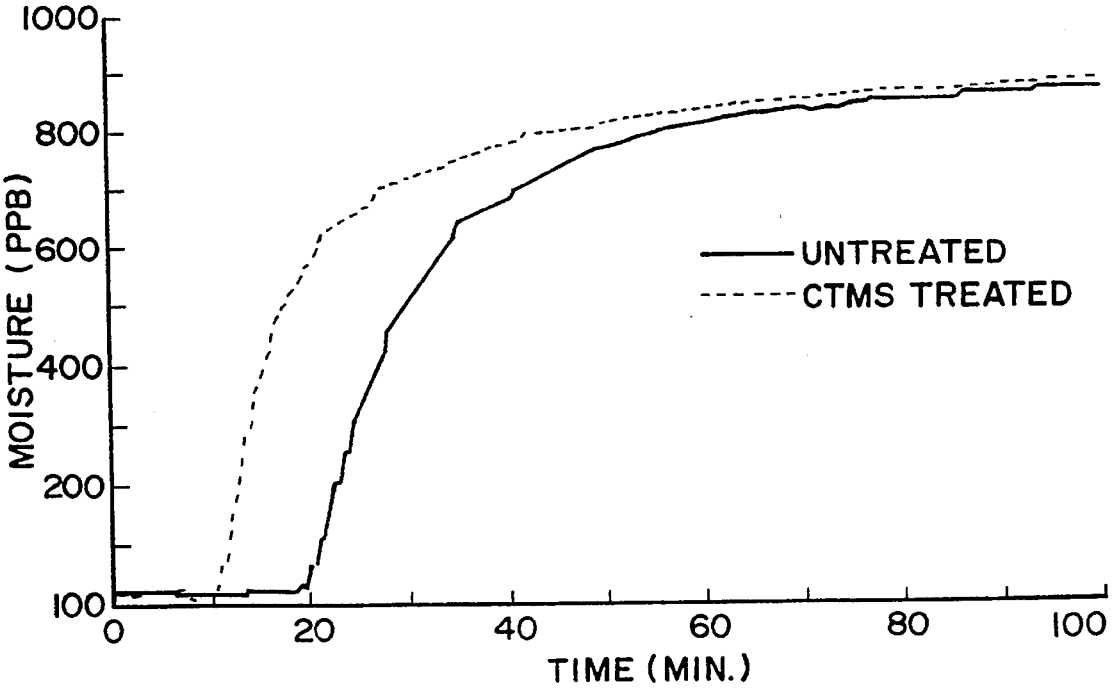
FIG. 7 is a graph of moisture (ppb) vs. time (min.) for a test filter passivated with chlorotrimethylsilane showing shortened breakthrough (therefore, less $H_2O$ readsorption) of moisture over an untreated filter.

Example 8 shows that CTMS can rapidly remove water adsorbed onto the stainless steel filter during treatment, reducing the dry-down time. CTMS also inhibits water from re-adsorbing during a post-treatment moisture exposure by producing a stable, hydrophobic surface. FIG. 7 shows the moisture uptake curves for the same filter, before (untreated) and after CTMS treatment. At time zero, the purge gas is switched from UHP $N_2$ ($H_2O$<20 ppb) to $N_2$ having a moisture level of 950 ppb. It takes 22 min. for the moisture front to appear at the outlet of the untreated filter whereas the breakthrough time for the CTMS treated filter is only 11 min. This breakthrough time is longer than the gas residence time (0.3 min) and results from water adsorbing on the walls of the tubing. The shorter breakthrough time after treatment means that less water adsorbs onto the filter surface during the moisture exposure.

EXAMPLE 10

Subsequent Dry-Down of Room Temperature CTMS Passivated Gas Filter.

Figure 8:
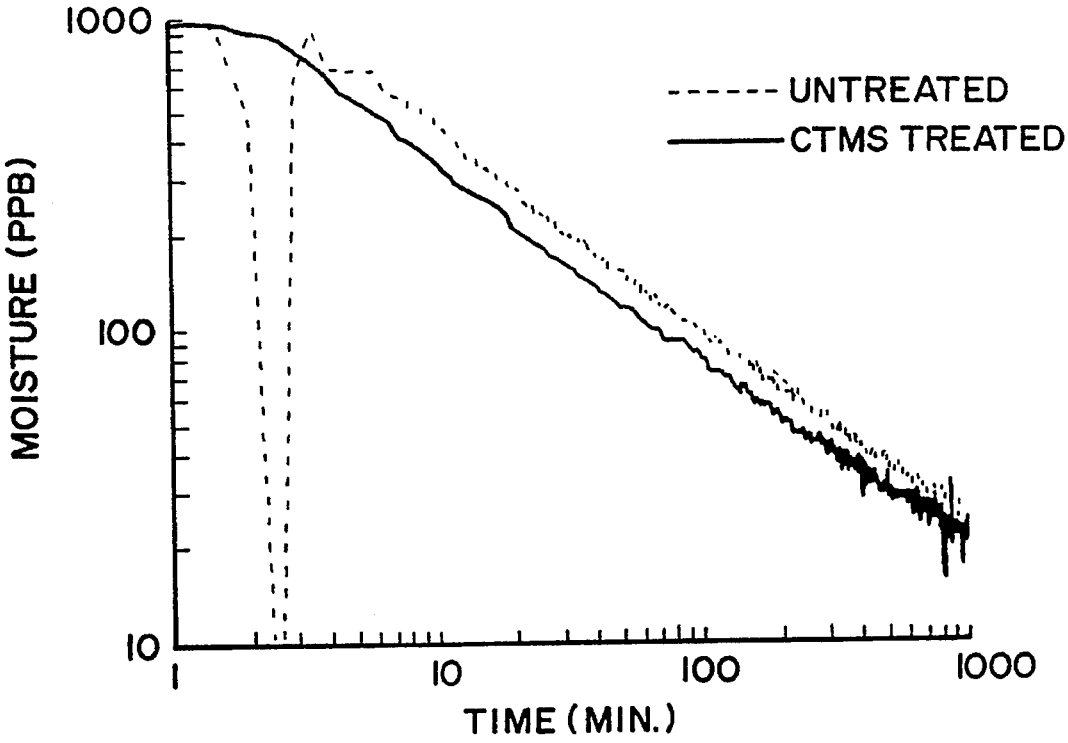
FIG. 8 is a graph of moisture (ppb) vs. time (min.) for a test filter passivated with chlorotrimethylsilane showing shortened drydown to 100 ppb $H_2O$ for the treated filter after equilibration of the filter with nitrogen containing 950 ppb of moisture.

Example 9 demonstrates that the CTMS treatment inhibits water from re-adsorbing by producing a stable, hydrophobic surface. A lower surface coverage is apparent by comparing the dry-down curves of the untreated and CTMS-treated filter after equilibrating with $N_2$ having a moisture level of 950 ppb (FIG. 8). The filter dries down much faster after the CTMS treatment, illustrating the stable nature of the surface generated by CTMS treatment.

EXAMPLE 11

Passivation of Stainless Steel Gas Filter with Chlorotrimethylsilane, CTMS at 65° C.

A stainless steel gas filter fitted with a valve on each end was equilibrated with nitrogen containing 1 ppm moisture. The valves were then closed and the filter attached to the manifold shown in FIG. 1. The bubbler in the manifold contained 35 mL of CTMS. Using a modification of the procedure described in Example 1, the test component (gas filter) was passivated by flowing 500 sccm of CTMS saturated nitrogen through the filter for 1.5 minutes at a pressure of 14.7 psia. V14 and V15 were then closed and gas filter was then heated to 65° C. for 15 minutes. The heating was then discontinued and the gas filter allowed to cool to room temperature for 30 minutes. The CTMS vapor was purged from the test component for 8.5 minutes, after which V14 and V15 were closed and the isolated filter was transferred to the moisture analyzer.

EXAMPLE 12

Initial Dry-Down of 65° C. CTMS Passivated Gas Filter.

Following the passivation described in Example 11, the stainless steel filter was purged with UHP $N_2$ ($H_2O$<20 ppb, 500 sccm) while monitoring the outlet moisture concentration. FIG. 6 shows dry-down curves for the untreated, and 65° C. CTMS treated filter. The time taken to passivate the filter (10 min.) has been included in the purge time and so there is no moisture measurement during the first 10 min. of the dry-down curve. The untreated filter takes 300 min. to dry down to 50 ppb whereas the 65° C. CTMS treatment enhances the rate of moisture removal, reducing the dry-down time by a factor of 4, to 74 min.

EXAMPLE 13

Passivation of a Stainless Steel Gas Filter with Chlorodimethylsilane, CDMS.

A stainless steel gas filter fitted with a valve on each end was equilibrated with nitrogen containing 1 ppm moisture. The valves were then closed and the tubing attached to the manifold shown in FIG. 1. The bubbler in the manifold contained 35 mL of CDMS. Using the procedure described in Example 1, the test component (gas filter) was passivated by flowing 500 sccm of CTMS saturated nitrogen through the filter for 1.5 minutes at a pressure of 14.7 psia. V14 and V15 were then closed and the CTMS saturated nitrogen was then allow to react with the moisture in the tubing for 15 minutes at a pressure of 30 psia. The CTMS vapor was purged from the test component for 8.5 minutes, after which V14 and V15 were closed and the isolated filter was transferred to the moisture analyzer.

EXAMPLE 14

Initial Dry-Down of the CDMS Passivated Gas Filter.

Figure 9:
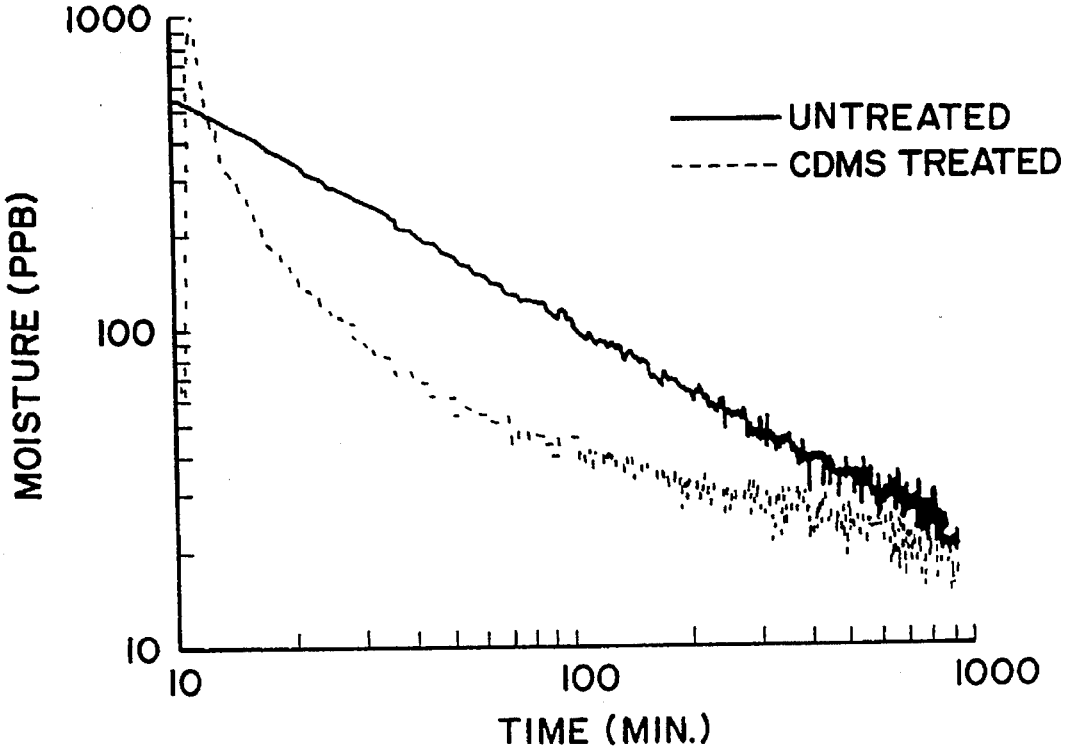
FIG. 9 is a graph of moisture (ppb) vs. time (min.) for a test filter passivated with chlorodimethylsilane showing shortened drydown to 50 ppb $H_2O$ for the treated filter.

Following the passivation described in Example 13, the stainless steel filter was purged with UHP $N_2$ ($H_2O$<20 ppb, 500 sccm) while monitoring the outlet moisture concentration. FIG. 9 shows dry-down curves for the same filter before, and immediately after, CDMS treatment. The time taken to passivate the filter (10 min.) has been included in the purge time and so there is no moisture measurement during the first 10 min. of the dry-down curve. The untreated filter takes 280 min. to dry down to 50 ppb whereas the CDMS treatment enhances the rate of moisture removal by a factor of 4.7, reducing the dry-down time to 60 min.

EXAMPLE 15

HBr Corrosion Testing of Unpassivated Stainless Steel.

Coupons of electropolished 316L stainless steel were cleaned then loaded into a Hastelloy C-22 reactor. The reactor was attached to the electropolished stainless steel manifold, heated at 100° C. and evacuated to $<10^{-3}$ torr for 12 hours in order to remove adsorbed moisture from the samples and reactor walls. The reactor was then allowed to cool to room temperature and exposed to a flowing nitrogen atmosphere contained 1000 ppm of moisture for 8 hours. The total pressure in the reactor was 15 psia. After 8 hours, the reactor was purged for 10 minutes with UHP $N_2$ ($H_2O$<20 ppb) flowing at 500 sccm, again at 15 psia total pressure. The reactor was then isolated and connected to an HBr manifold. HBr (15 psia) was added to the reactor bringing the total pressure to 30 psia. The reactor was then isolated and allowed to stand for 12 days. The HBr was then thoroughly removed from the reactor by repeatedly evacuating the atmosphere in the reactor to a pressure below 1 mtorr and back-filling with 30 psia of UHP $N_2$ ($H_2O$<20 ppb). The coupons were transported under nitrogen atmosphere to the scanning electron microscope in sealed, air-tight glass vials and were loaded into a polyethylene glove bag which was attached to the airlock chamber of the microscope. The glove bag was purged for approximately 16 hours with nitrogen before the sample vials were opened. This procedure was used to prevent exposing the coupons to ambient air and water vapor before analysis. Semi-quantitative standardless energy dispersive x-ray spectroscopy (EDS) analysis were performed to analyze the extent bromine incorporation (i.e. corrosion) of the coupons. The surface bromine concentration for these coupons was measured as 6.26 wt % bromine.

EXAMPLE 16

HBr Corrosion Testing of CTMS Passivated Stainless Steel.

This example demonstrated that the passivation of the present invention dramatically reduces the amount of reactive specialty gas induced corrosion of stainless steel. Coupons of electropolished 316L stainless steel were cleaned then loaded into a Hastelloy C-22 reactor as described in example 15. The procedure was the same as described in Example 15, with one exception. In this example, the coupons were not purged by flowing purified nitrogen for 10 minutes at 500 sccm. Instead, the coupons were passivated by flowing 500 sccm of CTMS saturated nitrogen through the reactor for 2 minutes at a pressure of 14.7 psia. V14 and V15 (see FIG. 1) were then closed and the CTMS saturated nitrogen was allow to react with the moisture in the reactor and passivate the coupons for 15 minutes. The CTMS vapor was then purged from the reactor for 8.0 minutes. The reactor was then isolated and connected to an HBr manifold. HBr (15 psia) was added to the reactor bringing the total pressure to 30 psia. The reactor was then isolated and allowed to stand for 12 days. The HBr was then thoroughly removed by repeatedly evacuating the atmosphere in the reactor to a pressure below 1 mtorr and back-filling with 30 psia of purified nitrogen. Semi-quantitative standardless EDS analysis were performed to analyze the extent bromine incorporation (i.e. corrosion) of the sample. The surface bromine concentration for this sample was measured as 0.7 wt % bromine, or about 1/10th the amount bromine incorporated into the unpassivated samples (Example 15).

EXAMPLE 17

Re-wetting of 65° C. CTMS Passivated Gas Filter.

Example 9 shows that room temperature, ambient pressure CTMS passivation inhibits water from re-adsorbing during a post-treatment moisture exposure by producing a stable, hydrophobic surface. Example 12 shows that a CTMS passivation at 65° C. enhances the rate of moisture removal, reducing the dry-down time. However, in this example, we show that 65° C. CTMS passivation does not inhibit water from re-adsorbing during a post-treatment moisture exposure. At time zero, the purge gas is switched from UHP $N_2$ ($H_2O$<20 ppb) to $N_2$ having a moisture level of 950 ppb. The moisture uptake curves for the same filter, before (untreated) and after 65° C. CTMS treatment were indistinguishable. This demonstrates that although 65° C. CTMS passivation substantially enhances the rate of moisture removal, 65° C. is too high a temperature to perform the passivation in order to achieve a stable hydrophobic surface.

The examples above demonstrate that the present invention provides an improved process for the removal of moisture rapidly from a metal surface such as an industrial gas delivery conduit and passivates such a metal surface by adhering a layer of hydrophobic drying reagent molecule derivatives to the surface at near ambient to super ambient pressure to retard the readsorption of moisture during subsequent use, such as in delivery of high purity industrial gases at positive pressure to an electronic component fabrication tool, where purity is critical and absence of moisture is also critical. This advantage of moisture removal and moisture passivation at ambient and super ambient pressure is achieved in the present invention with drying reagents having enhanced stability and safety while having reduced toxicity over the drying reagents of the prior art.

The present invention has been set forth with regard to several preferred embodiments, however the full scope of the present invention should be ascertained from the claims which follow.

We claim:

1. A process for moisture removal and moisture passivation of a surface on which moisture is absorbed comprising contacting said surface with a flow of a carrier gas at a pressure of at least approximately 14.7 psia containing a drying reagent to remove absorbed moisture from said surface and passivate said surface to retard the readsorption of moisture, wherein said drying reagent is a composition of the formula: $R_aSiX_bY_cZ_d$ where a=1–3; b, c, and d are individually 0–3 and a+b+c+d=4; R is one or more organic groups; and X, Y and Z are individually hydrogen, halogen, alkoxy, amine or —N(H)Si($R_3$), but at least one of X, Y or Z have a bond to silicon that is readily hydrolyzable.

2. The process of claim 1 wherein said organic groups are selected from the group consisting of alkyl, alkenyl, alkynyl, aryl, alkyl-substituted aryl, alkenyl-substituted aryl, alkynyl-substituted aryl, aryl substituted alkyl-, aryl substituted alkenyl-, aryl substituted alkynyl- and mixtures thereof.

3. The process of claim 1 wherein said drying reagent is a composition of the formula:

$$R_aSiH_{4-a}$$

wherein R is alkyl, alkenyl, alkynyl, aryl, alkyl-substituted aryl, alkenyl-substituted aryl, alkynyl-substituted aryl, aryl substituted alkyl-, aryl substituted alkenyl-, aryl substituted alkynyl- or mixtures thereof, and a is 1–3.

4. The process of claim 3 wherein R is methyl, ethyl, vinyl, propyl, butyl, pentane, hexyl, cyclohexyl, phenyl, or mixtures thereof.

5. The process of claim 1 wherein said drying reagent is a composition of the formula:

$$X_aSiH_bR_c$$

wherein R is alkyl, alkenyl, alkynyl, aryl, alkyl-substituted aryl, alkenyl-substituted aryl, alkynyl-substituted aryl, aryl substituted alkyl-, aryl substituted alkenyl-, aryl substituted alkynyl- or mixtures thereof, X is fluorine, bromine, chlorine, iodine or mixtures thereof, and a, b and c are individually 1–2, and a+b+c=4.

6. The process of claim 5 wherein R is methyl, ethyl, vinyl, propyl, butyl, pentane, hexyl, cyclohexyl, phenyl, or mixtures thereof.

7. The process of claim 1 wherein said drying reagent is a composition of the formula:

$$R_aSi(OR')_{4-a}$$

wherein R and R' are alkyl, alkenyl, alkynyl, aryl, alkyl-substituted aryl, alkenyl-substituted aryl, alkynyl-substituted aryl, aryl substituted alkyl-, aryl substituted alkenyl-, aryl substituted alkynyl- or mixtures thereof, and a is 1–3.

8. The process of claim 7 wherein R and R' are independently methyl, ethyl, vinyl, propyl, butyl, pentane, hexyl, cyclohexyl, phenyl, or mixtures thereof.

9. The process of claim 1 wherein said drying reagent is a composition of the formula:

$HN(SiR_3)_2$ wherein R is alkyl, alkenyl, alkynyl, aryl, alkyl-substituted aryl, alkenyl-substituted aryl, alkynyl-substituted aryl, aryl substituted alkyl-, aryl substituted alkenyl-, aryl substituted alkynyl- or mixtures thereof.

10. The process of claim 9 wherein R is methyl, ethyl, vinyl, propyl, butyl, pentane, hexyl, cyclohexyl, phenyl, or mixtures thereof.

11. The process of claim 1 wherein said flow of a carrier gas containing a drying reagent contacts said surface at a temperature no greater than approximately 65° C.

12. The process of claim 1 wherein said surface is a metal surface.

13. The process of claim 12 wherein said metal surface is steel.

14. The process of claim 12 wherein said metal surface is an interior of piping of a high purity gas delivery device.

15. A process for moisture removal and moisture passivation of an interior surface of a high purity gas piping on which moisture is absorbed, comprising: (a) purging said piping with an inert gas which has a moisture content below 0.1% by volume; and (b) contacting said surface at a pressure of at least approximately 14.7 psia and a temperature of less than approximately 65° C. with a flow of a carrier gas containing a drying reagent to remove absorbed moisture from said surface and passivate said surface to retard the readsorption of moisture, wherein said drying reagent is a composition of the formula: $R_aSiX_bY_cZ_d$ where a=1–3; b, c, and d are individually 0–3 and a+b+c+d=4; R is one or more organic groups; and X, Y and Z are individually hydrogen, halogen, alkoxy, amine or —$N(H)Si(R_3)$, but at least one of X, Y or Z have a bond to silicon that is readily hydrolyzable.

* * * * *